US005283113A

United States Patent [19]

Nishimura et al.

[11] Patent Number: 5,283,113

[45] Date of Patent: Feb. 1, 1994

[54] PROCESS FOR PRODUCING CARBON FIBER FELT

[75] Inventors: Yoshiyuki Nishimura; Mikio Watanabe; Kazuo Jonouchi, all of Ibaraki, Japan

[73] Assignee: Petoca, Ltd., Tokyo, Japan

[21] Appl. No.: 961,879

[22] Filed: Oct. 16, 1992

[30] Foreign Application Priority Data

Oct. 18, 1991 [JP] Japan ..... 3-297570

[51] Int. Cl.[5] ..... D04H 1/08

[52] U.S. Cl. ..... 428/280; 28/107; 28/112; 156/62.6; 156/62.8; 156/148; 156/155; 156/167; 264/29.1; 264/29.7; 423/447.1; 423/447.2; 423/447.3; 423/447.4; 423/447.8; 428/113; 428/300; 428/408

[58] Field of Search ..... 28/107, 112; 264/29.1, 264/29.7; 423/447.1, 447.2, 447.3, 447.4, 447.8; 156/62.6, 62.8, 155, 148, 167; 428/280, 408, 300, 113, 284, 109, 110

[56] References Cited

U.S. PATENT DOCUMENTS

| | | | |
|---|---|---|---|
| 3,515,621 | 6/1970 | Watson | 428/110 |
| 4,487,685 | 12/1984 | Watanabe | 208/44 |
| 4,512,874 | 4/1985 | Watanabe | 208/44 |
| 4,529,498 | 7/1985 | Watanabe | 208/44 |
| 4,529,499 | 7/1985 | Watanabe | 208/44 |
| 4,606,872 | 8/1986 | Watanabe | 264/29.4 |
| 4,750,964 | 6/1988 | Hettinger, Jr. et al. | 156/361 |
| 4,790,052 | 12/1988 | Olry | 28/110 |
| 4,814,121 | 3/1989 | Watanabe | 264/29.2 |
| 4,861,653 | 8/1989 | Parrish | 428/300 |
| 4,892,722 | 1/1990 | Suto et al. | 423/448 |
| 4,898,723 | 2/1990 | Suto et al. | 423/447.4 |
| 4,913,889 | 4/1990 | Takar et al. | 423/447.1 |
| 4,975,261 | 12/1990 | Takabatake | 423/445 |
| 4,975,262 | 12/1990 | Suto et al. | 423/447.1 |
| 5,004,511 | 4/1991 | Tamura et al. | 156/89 |
| 5,035,942 | 7/1991 | Nagata et al. | 428/288 |
| 5,071,631 | 12/1991 | Takabatake | 423/445 |
| 5,091,164 | 2/1992 | Takabatake | 423/445 |

FOREIGN PATENT DOCUMENTS

| | | |
|---|---|---|
| 0330179 | 8/1989 | European Pat. Off. . |
| 0336464 | 10/1989 | European Pat. Off. . |
| 0387829 | 9/1990 | European Pat. Off. . |
| 2302128 | 9/1976 | France . |
| 1447030 | 8/1976 | United Kingdom . |

*Primary Examiner*—James J. Bell

*Attorney, Agent, or Firm*—Oblon, Spivak, McClelland, Maier & Neustadt

[57] ABSTRACT

There is disclosed a process for continuously producing a pitch-based carbon fiber felt which comprises the steps of spinning a pitch by melt blow spinning system; accumulating the spun fibers as a pitch fiber web composed of the aggregate of short fibers; continuously cross lapping the web; subsequently stabilizing the cross lapped web; carbonizing and/or activating the stabilized web; and then felting the resultant web. The above-mentioned process is capable of efficiently producing a pitch-based carbon fiber felt having uniform unit weight and excellent physical properties and well suited for use in high-performance thermal insulator, cushioning thermal insulator, filter media and adsorbent for water purification and solvent recovery, etc.

10 Claims, No Drawings

PROCESS FOR PRODUCING CARBON FIBER FELT

BACKGROUND OF THE INVENTION

1. Field of the Invention

The present invention relates to a process for continuously producing a pitch-based carbon fiber felt excellent in uniformity of the unit weight and physical properties. The term "carbon fiber felt" as used herein includes activated carbon fiber felt as well.

Specifically, the pitch-based carbon fiber felt which is produced by the process of the present invention is excellent in uniformity of the unit weight and physical properties and provides high-performance thermal insulator, cushioning thermal insulator, filter media, adsorbent and the like. In particular, the pitch-based carbon fiber felt which is produced from optically anisotropic pitch as the raw meterial can be used in carbon-carbon composite, electrodes of an electric cell, nuclear fusion reactor walls, etc. Moreover, the activated carbon fiber felt can be efficiently utilized in water purification, solvent recovery and the like.

2. Description of Related Art

A pitch-based carbon fiber felt has heretofore been produced by the process comprising the step of collecting the pitch fibers that have been spun out by centrifugal spinning system, vortical spinning system or spunbond spinning system in the form of tow or sheet on a perforated belt; the step of stabilizing treatment in an oxidative atmosphere; the step of carbonizing treatment in an atmosphere of an inert gas, the step of direct activating treatment in an atmosphere of an activating gas, or the steps of carbonizing treatment in an atmosphere of an inert gas and subsequent activating treatment of the carbonized fibers; the step of webbing the pitch-based carbon fiber precursor in the form of tow or sheet obtained through the foregoing steps via independent carding treatment; the step of laminating the webbed precursor; and the step of fixing the fibers by entangling the fibers by needle punching, water jet and the like, or by bonding the fibers with an adhesive.

In the above-mentioned process, the fiber precursor in the form of tow or sheet brings about generally a shrinkage of about 5 to 20% in carbonizing treatment and about 10 to 50% in the activating treatment due to an intrinsic shrinkage caused by weight loss thereof and flexure of the fibers in the carbonizing and activating treatment.

The remarkable shrinkage of the fibers gives rise to ununiform shrinkage thereof in a carbonization or activation furnace which will lead to ununiform unit weight of the tow or sheet obtained therethrough, and in the extreme case, to breakage of the tow or sheet. Particularly in the case of activated carbon fiber, the above-mentioned shrinkage leads to ununiform specific surface area.

Also the above-mentioned process involves the problems of a lower process yield and impossibility of enhancing its strength because of the fiber precursor in the form of tow or sheet being hackled in the course of carding treatment. Particularly, in the case of low elongation fibers such as optically anisotropic pitch-based carbon fiber or particularly low-strength fibers such as activated carbon fiber, the above-mentioned process makes it difficult to produce a felt containing 100% of pitch-based carbon fiber and having a uniform unit weight, sufficient handleability and high strength.

On the other hand, melt-blow spinning system has the advantage of favorable productivity and capability of producing fine fibers having a fiber diameter of about 10 μm or smaller. However, in the case where the pitch-based fibers obtained by melt-blow spinning system having a finite length, especially the fine fibers having an average fiber diameter of about 10 μm or smaller are applied to the process for producing the pitch-based carbon fiber felt, there are caused more frequently the aforesaid shrinkage and/or breakage of the tow or sheet during the carbonizing treatment or activating treatment and the breakage of the fibers in the carding treatment, showing the tendency of increased ununiformity of the physical properties of the obtained felt such as the unit weight and specific surface area.

Conclusively, it was impossible by any of the conventional processes to produce a felt excellent in uniformity of physical properties in a high yield from pitch-based carbon fiber or activated carbon fiber. As a result of intensive investigation made by the present inventors on the above-mentioned problems, it was found by them to be effective to carry out the carbonizing treatment or activating treatment of the carbon fiber precursor which brings about a remarkable shrinkage under the condition enabling free shrinkage of the web. The present invention has been accomplished on the basis of the aforestated finding and information.

SUMMARY OF THE INVENTION

Accordingly, it is an object of the present invention to eliminate the problem of inferior uniformity of unit weight and physical properties of the conventional pitch-based carbon fiber felt.

It is another object of the present invention to provide a process for continuously producing a pitch-based carbon fiber felt excellent in uniformity and handleability comprising the fibers made by melt-blow spinning system which could never been felted by any of the conventional processes by reason of the remarkable shrinkage at the time of carbonization or activation.

Other objects of the present invention will become apparent from the detailed description to follow taken in conjunction with appended claims.

For the above-mentioned objects, the present invention provides a process for continuously producing a pitch-based carbon fiber felt which comprises the steps of spinning a pitch by melt-blow spinning system; accumulating the spun fibers as a pitch fiber web preferably on a perforated belt; continuously cross lapping the web; subsequently stabilizing the cross lapped web; carbonizing and/or activating the stabilized web; and then felting the resultant web. A preferred embodiment of the present invention is particularly characterized in that when the stabilized pitch fiber web is carbonized and/or activated, an inert gas or an activating gas is allowed to flow from the underside of the stabilized pitch fiber web to the upside thereof at a flow rate of 0.2 to 2.5 m/sec.

The present invention also provides a pitch-based carbon fiber felt having an average fiber diameter of 10 μm or smaller, a unit weight of 150 to 1000 g/m$^2$ and a variance of the unit weight in both the lengthwise and widthwise directions expressed in terms of coefficient of variation (CV) of 5% or less.

The process according to the present invention exerts a particularly excellent effect in the case of producing a felt having uniform unit weight and advanced physical properties from an activated carbon fiber web which undergoes a large shrinkage at the time of activating treatment.

DESCRIPTION OF PREFERRED EMBODIMENT

(1) Pitch and Pitch Fiber Web

The type of pitch to be employed in the present invention is not limited to petroleum-base nor coal tar-base, but is roughly divided into optically anisotropic type and optically isotropic type.

An optically anisotropic pitch is the pitch which comprises an anisotropic pitch as the principal component, from which is obtained carbon fibers having high tensile strength, high tensile modulus of elasticity, excellent chemical resistance and excellent resistance to oxidation at elevated temperatures.

In view of the physical properties of the carbon fiber to be obtained, a pitch having an optically anisotropic component of 70% or more is preferable.

On the other hand, an optically isotropic pitch is rich in aqueous gas reactivity and therefore, is preferably used as the raw material for activated carbon fiber.

The pitch-based short fibers obtained by melt-blow spinning system have usually a fiber diameter of 5 to 30 μm and a fiber length of several centimeters to several meters.

The pitch fiber web to be employed in the present invention has a unit weight of desirably 15 to 100 g/m$^2$. A unit weight thereof of less than 15 g/m$^2$ undesirably lowers the web strength and causes such problems as insufficient stability in releasing from the collecting belt, web breakage at the time of the web traverse in the cross lapping step, etc., whereas a unit weight exceeding 100 g/m$^2$ makes it difficult to evacuate the draw gas flow generated at the time of spinning through the accumulated pitch fiber web, thus undesirably causing rope-like mottles on the web surface and further, ununiform unit weight in producing a felt by cross lapping of the web.

Accordingly, it is advantageous to thinly accumulate the pitch fiber web and widely cross-lap the web (for example, 1 to 3 m in width) from the viewpoint of the equipment construction cost and the successive treatment in the process. Thus, the pitch fiber web has a unit weight of more disirably 20 to 90 g/m$^2$, most desirably 20 to 50 g/m$^2$.

As the spinning system to be employed in the process of the present invention, melt-blow spinning system is adopted to produce the fibers since it enables to optionally regulate the fiber diameter in the range of 5 to 30 μm, approximately, has several advantages such as a high output per unit time per one piece of spinning nozzle and excellent productivity and besides permits stable spinning, especially for the fine-diameter fibers. The fibers thus spun is preferably accumulated on a perforated belt while the draw gas flow is sucked from the rear side of the fibers. The flow rate of the gas sucked from suction holes is desirably 5 to 100 m/sec, more desirably 12 to 50 m/sec.

A flow rate of the gas lower than 5 m/sec undesirably causes floating of the pitch fiber in a spinning chamber, bulkiness of the obtained web and poor handleability thereof, whereas that exceeding 100 m/sec unfavorably brings about breakage and/or deterioration of the fibers.

(2) Cross-Lapping Treatment of Pitch Fiber Web

The accumulated pitch fiber web is introduced in a cross lapper without being cut off, continuously cross lapped to form multilayer, for example, generally lapping at least 8 layers or sheets to form multilayer (hereinafter, cross lapped web in the form of multilayer is referred to as "cross lapped web"), placed on a perforated belt and continuously fed in a stabilizing furnace.

The number of the laminated layers is appropriately selected taking into consideration the diameter of pitch fiber to be used, the successive processing, the aimed unit weight of the product to be obtained, the purpose of use of the final felt product and so forth. In order to assure the uniformity of the cross lapped web unit weight, desirably at least 8, more desirably 12 to 30 sheet should be laminated.

As a cross lapper to be used for producing cross lapped web, there may be optionally used a cross lapper which is publicly known in itself and used for laminating nonwoven fabrics, etc. However, taking into consideration the brittleness of the pitch fiber web, a horizontal type cross lapper is preferably used from the operational standpoint. In addition, from the viewpoint of antistatic property, the belt on which the cross lapped web is placed is preferably the one with electrical conductivity.

The unit weight of the cross lapped web varies depending upon the thread diameter and the unit weight of the aimed final product, but is desirably 200 to 1200 g/m$^2$, more desirably 300 to 1000 g/m$^2$.

It is possible in the cross lapping step in the process of the present invention to laminate the pitch fiber that can not be uniformly and stably accumulated at a unit weight of 100 g/m$^2$ or more in the spinning step so as to match the successive steps, thereby efficiently balancing the spinning step with the stabilizing step and successive steps. Specifically, the cross lapping prior to the stabilizing step has made it possible to thinly spin pitch fiber web, cross lap the web according to the unit weight of the final felt product, proceed with successive steps and thereby continuously carry out the whole steps. The process in which the stabilizing step is followed by cross lapping step makes it difficult to always balance the treatment capacity of the spinning step with that of the stabilizing step and leads to the disadvantage that continuous operation is impossible and the productivity is poor.

Moreover, the cross lapping treatment exhibits an extremely great effect against shrinkage which takes place at the time of carbonization or activation.

Specifically, the shrinkage takes place simultaneously in the progressing direction of the cross lapped web and in the direction of width in an amount of 5 to 20% in carbonization, and 10 to 50% in activation. The above shrinkage can be absorbed uniformly by the shift between the laminated surfaces of the web that has been laminated in multilayer.

According to the conventional processes, the shrinkage is concentrated on the place where the strength of the precursor web is minimized, the unit weight of the carbon fiber web coming out of a carbonizing or activating furnace is made ununiform and in the extreme case, the web is cut off.

Such ununiform shrinkage brings about ununiform streams of inert gas or activating gas and especially in the case of activated carbon fiber felt, the shrinkage is accompanied with such problems as ununiformity of specific surface area and micropore distribution. The phenomenon is remarkable in the longitudinal(flow) direction in the case of continuously treating the webs.

In the process of the present invention, the interlaminar adhesive strength is lower than the strength of the web itself owing to the multilayered lamination and, when shrinkage takes place in the laminate placed in a carbonizing furnace or an activating furnace, the shift due to the shrinkage is uniformly generated in the interlaminar section of the web having the lowest bonding stregth. Hence, despite the totally decreased unit weight, the product thus obtained makes itself a carbon fiber web excellent in uniformity of the unit weight and physical properties including specific surface area, etc.

(3) Stabilization of Cross Lapped Web

The cross lapped web can be stabilized continuously in liquid phase or gas phase by the use of a conventional process, but is preferably stabilized in an oxidative atmosphere containing air, oxygen, nitrogen dioxide or the like at a temperature from 200° to 400° C. and at an average temperature rise rate of 1° to 15° C./min, particularly 3° to 12° C./min.

(4) Carbonization and Activation

The cross lapped pitch fiber web after the stabilization is carbonized at a temperature from usually 500° to 1500° C., preferably 600° to 1200° C. in an atmosphere of an inert gas such as nitrogen or activated at a temperature from usually 500° to 1500° C., preferably 800° to 1200° C. in the presence of an activating gas such as steam or carbon dioxide and then entangled by needle punching or the like to form the objective pitch-based carbon fiber felt.

A carbonizing temperature lower than 500° C. results in a low strength of the carbon fiber to be obtained, a high friction coefficient and likelihood of damage to the fiber at the time of entangling treatment by needle punching or the like, while the temperature above 1500° C. will lead to an undesirably low elongation, especially with an optically anisotropic pitch-based fiber and likelihood of damage to the fiber such as cutoff and powdering, thereby remarkably decreasing the process yield. An activating temperature lower than 500° C. uneconomically lowers aqueous gas reactivity to an extreme extent, whereas the temperature exceeding 1500° C. undesirably causes deterioration of furnace materials.

In order to further uniformalize web shrinkage in a carbonizing furnace or an activating furnace, it is particularly effective to forcedly pass an inert gas or an activating gas from underside of the cross lapped web to upside thereof at a flow rate of preferably 0.2 to 2.5 m/sec, that is, to effect carbonization or activation under the floating condition (the weight of the cross lapped web itself is negligible) of the cross lapped web at an optimum flow rate which varies depending on the fiber diameter, unit weight, etc. but is usually in the range of 0.2 to 2.5 m/sec, thereby minimizing the contact resistance with the belt. A flow rate less than 0.2 m/sec results in failure to substantially float the cross lapped web with scarcely any effect, while that more than 2.5 m/sec is undesirable from the viewpoint of production stability since it causes the cross lapped web to scatter as the case may be.

As the effective means for generating the gas flow, there is available a method in which an inert gas or an activating gas is spouted from the underside of the perforated belt. It is also effective in the present invention to devise the shape of belt so as to minimize the contact resistance in enhancing free shrinkage of the cross lapped web.

In the process of the present invention, it is possible to effectively carry out the carbonization and activation of the stabilized cross lapped web in the same furnace by alternately switching over the atmospheric gas, but in the case where carbonization needs to be followed by activation, there may be installed a carbonizing furnace and an activating furnace in series in the downstream side of a stabilizing furnace to carry out continuous operation.

(5) Felting of Cross Lapped Web

In the process of the present invention, as the method of felting there are available entangling means such as needle punching treatment and water-jet treatment, an adhesion means in which fibers are fixed with an adhesive and the like, among which is preferable the needle punching treatment, which can dispense with effluent water treatment and simplify the operation.

In the case of needle punching for felting in the present invention, the needle punching density is preferably 3 to 120 punches/cm$^2$. A needle punching density less than 3 punches/cm$^2$ results in deterioration of felt stregth, dimensional stability and handleability, whereas the density exceeding 120 punches/cm$^2$ enhances felting treatment but undesirably increases damage to the fibers, conversely decreasing felt stregth.

It is possible in felting treatment by needle punching or the like to laminate a nonwoven fabric or cloth of other fiber having other properties such as high elongation on one side or both the sides of cross lapped web.

According to the present invention, it is possible to regulate the unit weight of the final product to 500 to 1000 g/m$^2$ in the case of a carbon fiber felt and to 150 to 500 g/m$^2$ in the case of an activated carbon fiber felt and also to suppress the variance of the unit weight in both the widthwise and lengthwise directions to 5% or less expressed in terms of coefficient of variation (CV).

The samples for measuring the variance of the unit weight are obtained by collecting 5 cm squares at every 20 cm distance in both the widthwise and lengthwise directions making a total of 10 pieces in each direction.

The fiber diameter of the final product is desirably 10 μm or smaller, more desirably in the range of 5 to 10 μm taking into consideration the thermal insulation properties at elevated temperatures in the case of a carbon fiber felt and the enlargeable surface area in the case of an activated carbon fiber felt.

In order to produce a felt having random fiber orientation and uniform unit weight, a method in which a card web is laminated and thereafter felted with a needle punch has heretofore been employed. However, in the case of the fibers with low elongation such as carbon fiber, especially optically anisotropic pitch-based carbon fiber or the fibers with extremely low strengh and brittleness such as activated carbon fiber, the fibers are cut off or powdered in the carding step, whereby the felt strength is markedly decreased, variance of the unit weight is increased and process yield is lowered.

A carbon fiber felt made from phenol, rayon or PAN is usually produced by a method wherein a felt is at first made by conventional carding treatment and thereafter the felt thus obtained is carbonized, graphitized or activated. In the above-mentioned method, however, the overall process yield through carbonization, graphitization or activation is 20 to 50% by weight based on the starting fiber material. Accordingly, the processing cost becomes 2 to 5 times when converted from the yield of the final product in spite of a high process yield in the carding step or the like, thus leading to an extremely high processing cost. Furthermore, the ununiform shrinkage in the carbonization step or activation step results in the production of the final product having only ununiform unit weight and physical properties.

The present invention solves the above-mentioned problems. Specifically, in the process of the present invention a pitch fiber web is accumulated in the spinning step; the pitch fiber web is continuously cross lapped; subsequently the cross-lapped web is stabilized; the stabilized web is carbonized and/or activated; and the resultant web is felted directly with needle punching or the like not by way of carding treatment.

More specifically the present invention provides a process which comprises accumulating in a thin state a pitch fiber web preferably having a unit weight of 15 to 100 g/m$^2$ consisting of the aggregate of short length fibers that have been spun by melt-blow spinning system; cross lapping the pitch fiber web; then stabilizing the cross lapped web; carbonizing and/or activating the stabilized web preferably in the forced stream of a gas flowing from the underside of the stabilized web towards the upside thereof; and finally felting the resultant web thus treated. By reason of uniform shrinkage occurring in the above-mentioned steps as well as unnecessary carding treatment, the process of the present invention is capable of continuously and inexpensively producing a pitch-based carbon fiber felt having excellent uniformity of the unit weight which could never been embodied by any of the conventional processes and having prominent physical properties such as high strength. In particular, the felt having an average fiber diameter of 10 μm or smaller is produced at a high process yield with high efficiency at a low cost.

In the following the present invention will be described in more detail with reference to the examples but it shall not be limited thereto.

EXAMPLE 1

A pitch fiber web was produced by melting a petroleum-base optically isotropic pitch having a softening point of 260° C. as the starting raw material, and drawing the molten pitch by the use of a spinneret having 1500 holes of 0.2 mm in diameter in a row in a slit of 3 mm in width and by spouting heated air through the slit under the conditions including a pitch discharge rate of 1500 g/min, pitch temperature of 325° C., heated air temperature of 330° C. and heated air pressure of 0.2 kg/cm$^2$G. The spun out fibers were accumulated on a belt made of stainless steel wire mesh with 20 mesh by suction from the rear side of the belt under an air flow rate of 32 m/sec to obtain a pitch fiber web having a unit weight of 25 g/m$^2$, an average fiber diameter of 7 μm, and an average fiber length of about 10 cm. The pitch fiber web was continuously cross lapped with a horizontal cross lapper so as to attain a unit weight of 600 g/m$^2$ and then stabilized in an air atmosphere by raising the temperature from room temperature to 300° C. at an average heat-up rate of 6° C./min. Subsequently the stabilized web was activated in an atmosphere of an activating gas comprising 40% steam fraction at 950° C. for 20 min. by passing the activating gas from the underside of the belt to the upside thereof at a flow rate of 1.2 m/sec and then was subjected to needle punching at a punching density of 10 punches/cm$^2$ and selvage cutoff at both ends to obtain an activated carbon fiber felt having a unit weight of 300 g/m$^2$, and an average fiber diameter of 6 μm. The series of steps from the above-mentioned spinning through the needle punching were continuously carried out. The felt was cut into 5 cm square samples at every 20 cm distance in both the widthwise and lengthwise directions making a total of 10 samples, respectively, and measured for the variance of the unit weight in both the widthwise and lengthwise directions in terms of coefficient of variation(CV). The results obtained (CV) were 2.8% and 3.1%, respectively, showing sufficiently small values and uniform unit weight. Measurement was made also of the iodine adsorption of the samples used for measuring the unit weight. The result obtained was 1760 mg/g in average with CV value of 3.4%, also showing uniform values.

COMPARATIVE EXAMPLE 1

Following the procedure in Example 1, a pitch fiber web having a unit weight of 250 g/m$^2$ was accumulated and activated except that cross lapping and forcedly passing the gas stream during the activation step were omitted. The activated carbon fiber web discharged from the activating furnace was cut off at an interval of about 2 m, causing about 50 cm clearances among the cut off pieces. The iodine adsorption was measured in the same manner as in Example 1. The result obtained gave smaller values in the central part of the web with CV value of 12.6%, thus showing large variances.

EXAMPLE 2

A pitch fiber web was produced by melting a petroleum-base optically anisotropic pitch having an anisotropic proportion of 98% and a softening point of 285° C. as the starting raw material, and drawing the molten pitch by the use of a spinneret having 1500 holes of 0.15 mm in diameter in a row in a slit of 3 mm width and by spouting heated air through the slit under the conditions including a pitch discharge rate of 1500 g/min, pitch temperature of 345° C, heated air temperature of 360° C. and heated air pressure of 0.5 kg/cm$^2$G. The spun out fibers were accumulated on a belt made of stainless steel wire mesh with 20 mesh by suction from the rear side of the belt under an air flow rate of 32 m/sec to obtain a pitch fiber web having a unit weight of 50 g/m$^2$, an average fiber diameter of 10 μm and an average fiber length of about 15 cm. The pitch fiber web was continuously cross lapped with a horizontal cross lapper so as to attain a unit weight of 600 g/m$^2$ without being treated in a cutoff step and then stabilized in an air atmosphere by raising the temperature from room temperature to 320° C. at an average heat-up rate of 4° C./min. Subsequently the stabilized web was carbonized by passing nitrogen from the underside of the belt to the upside thereof at a velocity of 1.0 m/sec and elevating a temperature up to 1000° C., and then was subjected to needle punching at a punching density of 10 punches/cm$^2$ and selvage cutoff at both ends to obtain a carbon fiber felt having a unit weight of 550 g/m$^2$, and an average fiber diameter of 9 μm. The series of steps from the above-mentioned spinning through the needle punching were continuously carried out. The felt was cut into 5 cm square samples at every 20 cm distance in both the widthwise and lengthwise directions making a total of 10 samples, respectively, and measured for the average variance of the unit weight in both the widthwise and lengthwise directions in terms of coefficient of variation (CV). The results obtained (CV) were 2.6% and 3.0%, respectively, showing sufficiently small values and uniform unit weight. The felt having a strength of 1353 g/5 cm width was obtained in an overall process yield of 78% by weight from the spinning step to the final felting step.

COMPARATIVE EXAMPLE 2

Following the procedure in Example 2, a pitch fiber web having a unit weight of 250 g/m$^2$ was accumulated and carbonized at 1000° C. except that cross lapping and forcedly passing the nitrogen stream during the carbonization step were omitted.

The pitch fiber web thus obtained was subjected to carding treatment by the conventional process and needle punching to obtain a carbon fiber felt having a unit weight of 550 g/m$^2$. Following the procedure in Example 2, measurement was made of the variance (CV) of the unit weight in both the widthwise and lengthwise directions. The results obtained (CV) were 7.2% and 8.9%, respectively, revealing large values and ununiform unit weight. In addition, the felt as the final product gave a low strength, i.e. 530 g/5 cm width. The overall process yield from the spinning step to the final felting step was 47% by weight, that is, extremely low as compared with the process yield obtained in Example 2.

What is claimed is:

1. A process for continuously producing a pitch-based carbon fiber felt which comprises the steps of spinning a pitch by melt-blow spinning system; accumulating the spun fibers as a pitch fiber web; continuously cross lapping the pitch fiber web; subsequently stabilizing the cross lapped web; subjecting the stabilized web to at least one treatment selected from carbonization and activation under such condition that the weight of the cross lapped web itself is negligible; and then felting the resultant web.

2. The process accoring to claim 1, characterized by allowing an inert gas or an activating gas to flow from the underside of the stabilized web to the upside thereof at a flow rate of 0.2 to 2.5 m/sec in at least one treatment selected from carbonization and activation.

3. The process according to claim 1 wherein the stabilized web is carbonized and then felted.

4. The process according to claim 1 wherein the stabilized web is activated and then felted.

5. The process according to claim 1 wherein the stabilized web is carbonized, activated and then felted.

6. The process acording to claim 1 wherein the pitch fiber web obtained by melt-blow spinning system consists essentially of aggregates of uneven length short fibers.

7. The process according to claim 1 wherein the cross lapped web has a unit weight of 200 to 1200 g/m$^2$.

8. The process according to claim 1 wherein the felting of the cross lapped web is effected by needle punching treatment at a needle punching density of 3 to 120 punches/cm$^2$.

9. The process according to claim 1, wherein the carbonization or activation is effected under floating condition of the cross lapped web.

10. A pitch-based carbon fiber felt which has an average fiber diameter of 10 μm or smaller, a unit weight of 150 to 1000 g/m$^2$ and a variance of the unit weight in both the widthwise and lengthwise directions expressed in terms of coefficient of variation (CV) of 5% or less.

* * * * *